United States Patent [19]

Nakazawa

[11] Patent Number: 4,652,140

[45] Date of Patent: Mar. 24, 1987

[54] MULTI ALARM TIMEPIECE

[75] Inventor: Eiji Nakazawa, Tokyo, Japan

[73] Assignee: Casio Computer Co., Ltd., Tokyo, Japan

[21] Appl. No.: 898,366

[22] Filed: Aug. 20, 1986

[30] Foreign Application Priority Data

Aug. 29, 1985 [JP] Japan ..... 60-191511

[51] Int. Cl.[4] ..... G04B 27/08; G04B 19/04

[52] U.S. Cl. ..... 368/74; 368/80; 368/261

[58] Field of Search ..... 368/28, 72–74, 368/76, 80, 155–157, 160, 185, 187, 250, 251, 261

[56] References Cited

U.S. PATENT DOCUMENTS

| | | | |
|---|---|---|---|
| 3,775,967 | 12/1973 | Spadini | 368/73 |
| 4,196,583 | 4/1980 | Komaki | 368/73 |
| 4,223,523 | 9/1980 | Kamiyo | 368/74 |
| 4,266,288 | 5/1981 | Berney | 368/28 |
| 4,272,836 | 6/1981 | Tamaru et al. | 368/74 |
| 4,358,840 | 11/1982 | Ono et al. | 368/251 |
| 4,364,669 | 12/1982 | Thoenig et al. | 368/111 |
| 4,433,918 | 2/1984 | Nishimura et al. | 368/74 |
| 4,470,706 | 9/1984 | Nishimura et al. | 368/74 |
| 4,470,707 | 9/1984 | Chamson et al. | 368/74 |
| 4,493,559 | 1/1985 | Ishida et al. | 368/74 |
| 4,505,594 | 3/1985 | Kawahara et al. | 368/73 |

*Primary Examiner*—Vit W. Miska

*Attorney, Agent, or Firm*—Frishauf, Holtz, Goodman & Woodward

[57] ABSTRACT

In an analog type timepiece, no electronic display is provided, and a plurality of alarm times are presettable. These preset alarm times can be easily recognized by using a simple hand. A reference signal oscillator, wave shapers, stepping motors, counters, coincidence detector and a buzzer are provided in the timepiece, thereby sequentially quick-shifting the hand mechanism to the predetermined alarm time positions.

8 Claims, 7 Drawing Figures

0

0

0

1H 15M

1M 3H 30M

5M 1H 15M

0

3H 30M

MULTI ALARM TIMEPIECE

BACKGROUND OF THE INVENTION

1. Field of the Invention

The present invention relates to a multi alarm timepiece for indicating times with hands and having a multi alarm function for producing an alarm sound when the hands have reached each of the preset alarm times.

2. Description of Prior Art

In one conventional analog alarm timepiece, an auxiliary hand is provided coaxially with the usual hour and minute hands and an alarm time is set mechanically by the auxiliary hand. Such an analog alarm timepiece is known from, for instance, U.S. Pat. No. 3,775,967.

In another conventional timepiece other than those using auxiliary hands, an alarm time is electronically set and an alarm sound is produced when hands have reached the preset alarm time. More particularly, a timepiece of the latter type includes hour and minute hands, an electronic time counter for counting a time identical to one indicated by the hour and minute hands, an alarm time memory circuit for electronically storing an alarm time, and a display unit for optically displaying the time of the time counter and the alarm time of the alarm time memory circuit, an alarm sound being produced when the time of the time counter coincides with the alarm time of the alarm time memory circuit. The above-described timepiece is disclosed in U.S. Pat. No. 4,196,583.

In the former analog alarm timepiece having the auxiliary hand, since an alarm time is set mechanically, higher precision cannot be expected and a setting time error may be caused. In addition, such an alarm timepiece employs complex mechanical structures, resulting in mechanical troubles.

In the latter analog alarm timepiece having the electronic time counter and the alarm time memory circuit, a display unit for displaying the content of the time counter is required in order to match the content of the electronic time counter with the time indicated by the hands. Moreover, both the present time and an alarm time must be set, resulting in a cumbersome operation.

In addition, since the latter timepiece has a display unit, the size of the timepiece is necessarily increased and has a poor outer appearance from the viewpoint of design.

SUMMARY OF THE INVENTION

The present invention has been made in view of the above situation and has as its object to provide such an analog multi alarm timepiece that no optical display unit is provided, a plurality of alarm times can be correctly preset, and a detection can be quite easily made when the preset alarm time has been reached.

To achieve the above object and other features, according to the present invention, the multi alarm timepiece comprises oscillating means for generating a reference signal, frequency dividing means for frequency-dividing the reference signal of the oscillating means to produce a predetermined time period signal, stepping motor means driven by the predetermined time period signal derived from said frequency dividing means, and a hand mechanism, constituted of at least an hour hand and a minute hand, and driven by said stepping motor to indicate a time, characterized by further comprising alarm setting switch means for setting an alarm time, time difference memory means for storing first time difference data between a time indicated by said hand mechanism and an alarm time, and second time difference data from the alarm time to a succeeding alarm time, by operating said alarm setting switch means, alarm time data memory means for storing third time difference data between a present time indicated by said hand mechanism and the succeeding alarm time, detecting means for detecting that said hand mechanism is driven in response to the predetermined time period signal by an amount corresponding to the third time difference data stored in said alarm time data memory means, alarm sound producing means for producing an alarm sound in response to a detection signal from said detecting means, and supply means for supplying to said alarm time data memory means the second time difference signal stored in said time difference memory means the alarm time and the next alarm time in response to the detection signal from said detecting means.

With the above arrangement, although the multi alarm timepiece of the present invention is of analog type, a plurality of alarm times can be precisely set, simple and quick setting operation can be realized and the preset alarm times are quite easily detectable.

BRIEF DESCRIPTION OF THE DRAWINGS

Further features of the invention will become apparent from the following description of a preferred embodiment of the invention, taken in conjunction with the accompanying drawings.

DETAILED DESCRIPTION OF THE PREFERRED EMBODIMENT

Multi Alarm Timepiece

Figure 1:
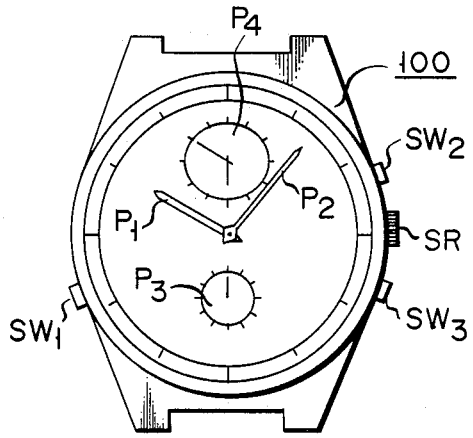
FIG. 1 shows an outer appearance of a multi alarm timepiece according to the present invention.

FIG. 1 shows an outer appearance of a multi alarm timepiece according to an embodiment of the present invention. Referring to FIG. 1, in addition to a hour hand P1, a minute hand P2, and a second hand P3 each for indicating a present time, alarm time hands P4 for indicating the hour and minute of an alarm time are provided. Switches SW1 to SW3 for moving hands P4 so as to set an alarm time are also provided. Crown SR is used to initialize hands P1, P2, and P3.

Circuit Arrangement of Timepiece

Figure 2:
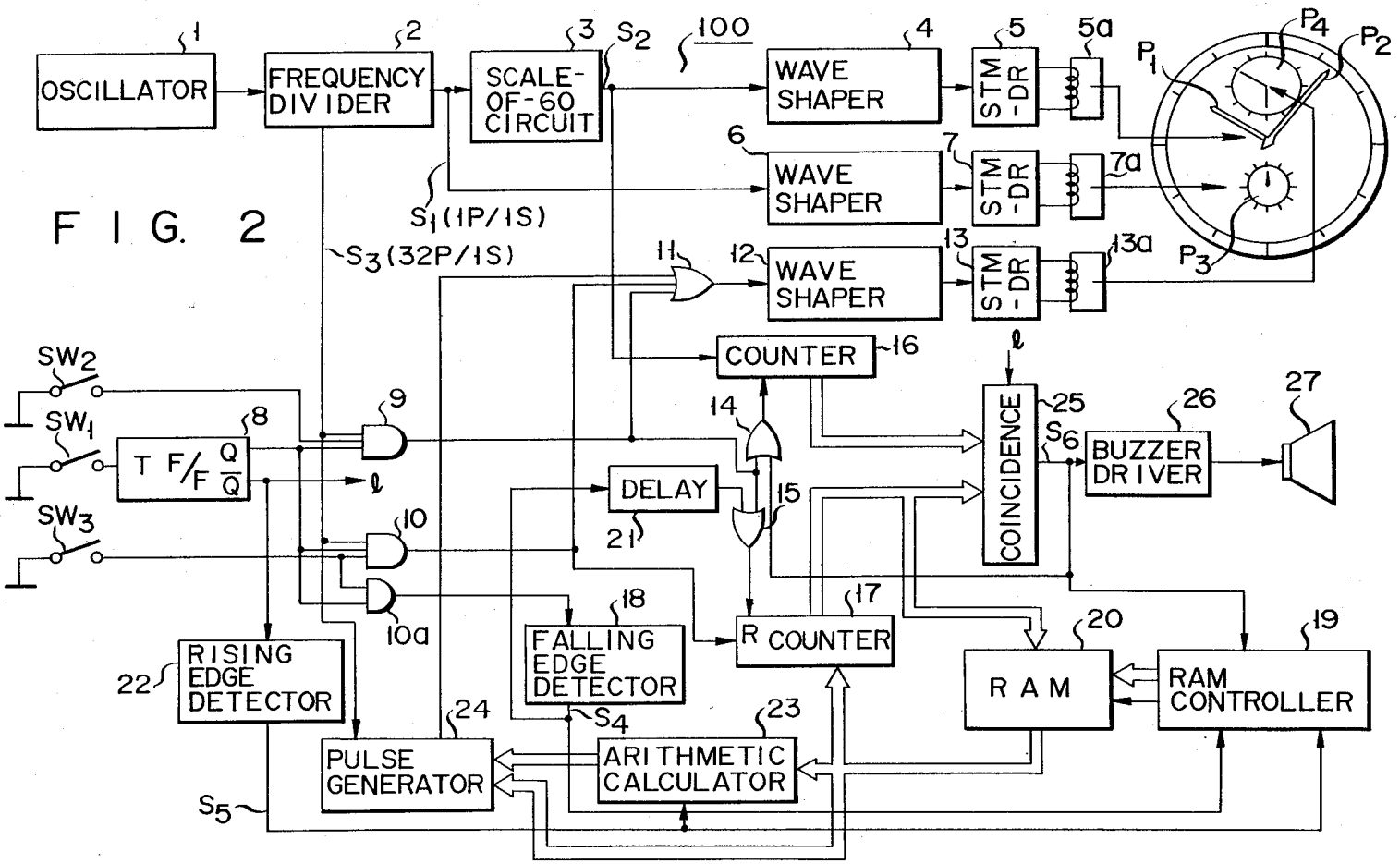
FIG. 2 is a schematic circuit diagram of the multi alarm timepiece shown in FIG. 1.

FIG. 2 shows an internal circuit diagram of analog alarm timepiece 100 according to this embodiment. Referring to FIG. 2, a clock pulse having a high frequency is produced from oscillator 1. This clock pulse is frequency-divided by frequency divider 2 into a second signal S1 of a 1-second period, and is then converted by a scale-of-60-circuit 3 into a minute signal S2 of a 1-minute period. The minute signal S2 output by a scale-of-60-circuit 3 is supplied to stepping motor driver 5 through wave shaper 4 to rotate hands P2 and P1 by driving stepping motor 5*a*. The second signal S1 output from frequency divider 2 is supplied to stepping motor driver 7 through wave shaper 6 so as to drive stepping motor 7*a*, thereby rotating hand P3 in the same manner as described above. In this manner, the present time can be indicated by hands P1, P2, and P3.

Switches SW1 to SW3 shown in FIG. 2 are identical to those shown in FIG. 1. A signal from switch SW1 is input to flip-flop 8. Set output Q of flip-flop 8 is input to AND gates 9 and 10. AND gate 9 also receives quick-shift signal S3 constituted of 32 pulses/second from switch SW2. AND gate 10 also receives a signal from switch SW3 and signal S3.

When switch SW2 is turned on while flip-flop 8 is set, signal S3 is output from AND gate 9. Signal S3 drives stepping motor 13*a* through OR gate 11, wave shaper 12, and stepping motor driver 13, so as to quick-rotate hands P4 at 32 Hz. Signal S3 from AND gate 9 is also input to the reset terminals of counter 16 and alarm time data memory counter 17 through OR gates 14 and 15, respectively. The former counter 16 counts shift amounts occurring in the hand mechanism. The latter counter 17 counts data related to an alarm time, i.e., time difference between the present time and the alarm time, and stores the resultant count data. These counters 16 and 17 are arranged by a scale of 720 counter (60 times 12 being 720) for indicating 12 hours. Counter 16 receives signal S2 output from circuit 3 and counts its pulses. When switch SW2 is switched from ON to OFF, counter 16 begins to count the pulses of signal S2.

When switch SW3 is turned on while flip-flop 8 is set, quick-shift signal S3 is output from AND gate 10. While switch SW3 is operated, AND gate 10*a* receives set output Q from flip-flop 8 and also an operation signal from switch SW3, and then outputs this operation signal from switch SW3. Signal S3 from gate 10 rotates hands P4 through OR gate 11 and other relevant circuit elements in the same manner as described above. Signal S3 is also supplied to counter 17 to be counted therein. When operation of switch SW3 is stopped, the falling edge of the signal from gate 10*a* is detected by falling edge detector 18, and detection signal S4 is supplied to RAM controller 19. Upon receipt of signal S4, controller 19 writes the number of pulses counted by counter 17 in RAM 20 as time difference data. Time difference data is written every time signal S4 is input to controller 19. It should be noted that signal S4 is also input to the reset terminal of counter 17 through delay circuit 21 and OR gate 15 after the data is written in RAM 20. As a result, counter 17 starts new data counting every time the time difference data is written in RAM 20 in response to ON/OFF of switch SW3.

Signal l from reset output $\overline{Q}$ of flip-flop is input to rising edge detector 22. When switch SW1 is depressed while flip-flop 8 is set, output $\overline{Q}$ is changed from L (low) to H (high) level and its rising edge is detected by detector 22. Detection signal S5 from detector 22 is supplied to arithmetic calculator 23 and RAM controller 19. Upon receipt of signal S5, controller 19 supplies first time difference data written in RAM 20 to counter 17 and, at the same time, supplies all time data written in RAM 20 to calculator 23. Calculator 23 performs arithmetic operation of "12 (hours) minus sum of all time difference data plus first time difference data". The calculation result is supplied to pulse generator 24. Pulse generator 24 also receives signal S3 from frequency divider 2 and then outputs pulses corresponding to the calculation result at a rate of 32 pulses/second. The pulses output from generator 24 are input to OR gate 11, and the hands of the alarm time hands are rotated through wave shaper 12, driver 13, and motor 13*a*, by an angular interval corresponding to the number of output pulses.

Output signal l from output $\overline{Q}$ of flip-flop 8 is also input to coincidence circuit 25. When the level of output $\overline{Q}$ of flip-flop 8 is changed to H level, circuit 25 detects a coincidence between data of counter 16 and data of counter 17. In this case, counter 16 has counted the minute signals S2 generated after turning off switch SW2, whereas counter 17 stores the first time difference data supplied from RAM 20. When a coincidence is established between these data, coincidence circuit 25 outputs coincidence signal S6. This coincidence signal S6 is input to buzzer driver 26, and buzzer 27 produces an alarm sound. Signal S6 also resets counter 16 through OR gate 14 and, at the same time, is supplied to controller 19. Counter 16 newly starts counting in response to signal S6. Upon receipt of coincidence signal S6, controller 19 supplies the second time difference written in RAM 20 to counter 17 and to pulse generator 24. Generator 24 outputs pulses corresponding to the time difference data. Therefore, in the same manner as described above, alarm time hands P4 are rotated for an angular interval corresponding to the number of pulses supplied from generator 24. Circuit 25 continues coincidence detection. When the next coincidence signal S6 is input to controller 19, controller 19 supplies third time difference data written in RAM 20 to generator 24 and counter 17, in the same manner as described above. In this way, every time coincidence signal S6 is output, a plurality of time difference data written in RAM 20 is supplied to counter 17 and generator 24. Alarm time hands P4 are rotated through an angular interval corresponding to the time difference supplied from generator 24. At the same time, circuit 25 restarts a coincidence detection.

Alarm Operations

FIGS. 3A to 3E show displays of alarm time setting and alarm operations which are performed by operating switches SW1, SW2, and SW3. Assume that an alarm time is set at, e.g., 11:30 and 3:00. The upper blocks of FIGS. 3A to 3E indicate time data of counter 16, respectively, and the lower blocks thereof indicate time difference data of counter 17, respectively.

In FIG. 2, suppose that switch SW1 is turned on to set flip-flop 8, and thereafter switch SW2 is turned on. Upon this operation, signal S3 from frequency divider 2 is supplied to stepping motor driver 13 through AND gate 9, OR gate 11, and wave shaper 12, and hands P4 start their quick-shift rotation. When hands P4 reach the present time, i.e., 10:15, switch SW2 is turned off to stop hands P4. Counters 16 and 17 are reset while switch SW2 is ON. Therefore, at this time, neither counter 16 nor 17 stores data.

Figure 3A:
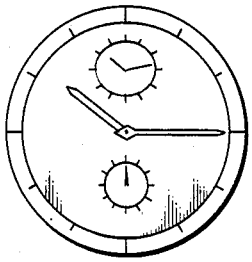
FIGS. 3A to 3C are illustrations showing display states and the contents of counters when alarm times are preset, respectively.
Figure 3B:
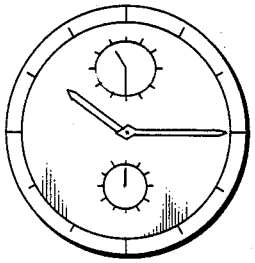

After switch SW2 is turned off, switch SW3 is turned on. Upon this operation, signal S3 is output from AND gate 10, and hands P4 are rotated for quick feed in the same manner as described above. As shown in FIG. 3B, when hands P4 reach a desired alarm time, i.e., 11:30, switch SW3 is turned off to stop hands P4. At this time, counter 17 stores time difference data corresponding to the quick-shift amount of hands P4. More particularly, since hands P4 are fed quickly from the present time (10:15) to the alarm time (11:30), time difference data (1:15) is stored in counter 17. This time difference data is written in RAM 20 by signal S4 of detector 18 which detects a falling edge of an output from AND gate 10*a*, and counter 17 is reset immediately thereafter. It should be noted that since one minute suffices to allow the alarm time to be set, no time data is stored yet in counter 16 at this time.

Figure 3C:
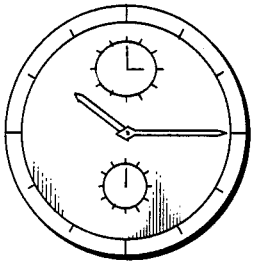

Subsequently, assume that a next alarm time is to be set at 3:00. In this case, switch SW3 is similarly depressed to feed hands P4 quickly to 3:00. In this condition, counter 17 stores time difference data, i.e., 3:30, obtained by subtracting the next alarm time (3:00) from the first alarm time (11:30), as shown in FIG. 3C. This time difference data is written in RAM 20 successively after the first time difference, and counter 17 is reset immediately thereafter. Meanwhile, counter 16 counts an elapsed time (e.g., 1 minute, as shown in FIG. 3C) since switch SW2 was turned off.

When third, fourth, . . . alarm times are to be et, switch SW3 is repeatedly depressed in the same manner as described above, so that third, fourth, . . . time difference data are sequentially written in RAM 20.

Figure 3D:
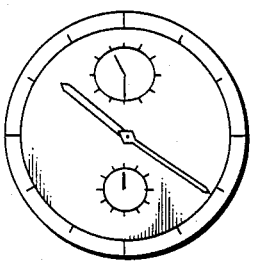
FIGS. 3D and 3E show alarm time display modes, respectively.

After all the desired alarm times are set, switch SW1 is depressed to reset flip-flop 8. Upon this operation, all the time difference data written in RAM 20 are supplied to arithmetic calculator 23, and the arithmetic operation of "12 (hours) minus sum of all time difference data plus first time difference data" is performed in order to quick-feed hands P4 to the positions of the first alarm time. In the example shown in FIGS. 3A to 3C, "12:00−(1:15+3:30)+1:15" is calculated and 8:30 is obtained. Pulse generator 24 outputs signals S3 corresponding to this operation result. Therefore, alarm time hands P4 are fed quickly for an amount corresponding to 8:30 from the last alarm time (3:00) and are stopped at the first alarm time, i.e., 11:30, as shown in FIG. 3D. As a result, the first alarm time is clearly indicated. Meanwhile, the first time difference data (1:15) written in RAM 20 is supplied to counter 17 in response to turning switch SW1 off. Counter 16 continues to count the elapsed time (5 minutes).

With the above operations of switches SW1 to SW3, presetting all the alarm times is completed. Under this state, after the last turning off switch SW3, coincidence circuit 25 detects coincidence between the time data of counter 16 and the time difference data of counter 17. When the present time reaches (11:30), counter 16 counts (1:15), which coincides with the time difference data (1:15) of counter 17. Then, buzzer 27 produces an alarm sound.

Figure 3E:
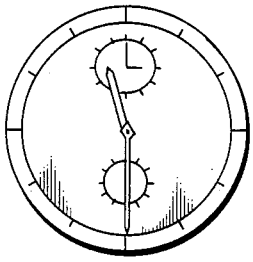

In synchronism with the alarming, next time difference data (3:30) is supplied to counter 17 and pulse generator 24 from RAM 20, and hands P4 are fed quickly for an amount corresponding to the time difference. More particularly, hands P4 are fed quickly from the first alarm time (11:30) for an amount corresponding to 3:30, as shown in FIG. 3E, and are stopped at the next alarm time (3:00). As a result, the next alarm time is clearly indicated. Meanwhile, counter 16 is reset in synchronism with the coincidence detection by circuit 25, and starts counting again thereafter. When the elapsed time coincides with the time difference data (3:30) of counter 17, an alarm sound is produced and the same process as described above is performed. In this manner, when a plurality of alarm times are to be set, this operation is performed repeatedly.

In the above embodiment, the alarm time hands consist of an hour hand and a minute hand. However, only one hand like a conventional auxiliary hand may be provided. In this case, the hand moves in units of 12 minutes. For example, when the hand points to a position corresponding to 5 minutes of an ordinary timepiece, it indicates (1:00). When the hand points to a position corresponding to 6 minutes of an ordinary timepiece, it indicates (1:12). Alternatively, the scale can be calibrated in 48 divisions, so that one scale unit corresponds to 15 minutes.

Although the alarm time hands are provided at a position different from the present time hands in the above embodiment, they may be provided to be coaxial therewith.

What is claimed is:

1. A multi-alarm timepiece comprising:

oscillating means for generating a reference signal;

frequency dividing means for frequency-dividing the reference signal of the oscillating means to produce a predetermined time period signal;

stepping motor means driven by the predetermined time period signal derived from said frequency dividing means;

a hand mechanism, including at least an hour hand and a minute hand, and driven by said stepping motor to indicate a time;

alarm setting switch means for setting an alarm time;

time difference memory means for storing first time difference data between a time indicated by said hand mechanism and an alarm time, and second time difference data from the alarm time to a succeeding alarm time, by operating said alarm setting switch means;

alarm time data memory means for storing third time difference data between a present time indicated by said hand mechanism and the succeeding alarm time;

detecting means for detecting that said hand mechanism is driven in response to the predetermined time period signal by an amount corresponding to the third time difference data stored in said alarm time data memory means;

alarm sound producing means for producing an alarm sound in response to a detection signal from said detecting means; and supply means for supplying to said alarm time data memory means the second time difference signal stored in said time difference memory means in response to the detection signal from said detecting means.

2. A timepiece as claimed in claim 1, wherein the timepiece further comprises alarm hand means for indicating the alarm time, and that said alarm setting switch means includes first switching means for matching said alarm hand means with said hand mechanism, and second switching means for quick-shifting up to a position indicating the alarm time said alarm hand means matched with said hand mechanism by said first switching means.

3. A timepiece as claimed in claim 2, wherein said alarm hand means comprises a stepping motor other than said stepping motor means for driving said hand mechanism.

4. A timepiece as claimed in claim 1, wherein the timepiece further comprises alarm hand means for indicating the alarm time, and said alarm hand means including quick-shifting means which is quickly fed by the second time difference data between the alarm time and the succeeding alarm time in order to indicate the next alarm time, said second time difference data being output from said time difference memory means.

5. A timepiece as claimed in claim 1, wherein the timepiece further comprises alarm hand means for indicating the alarm time, ahd quick-shifting means for sequentially quick-shifting said alarm hand means to a plurality of positions indicating a plurality of alarm times by operating said alarm setting switch means.

6. A timepiece as claimed in claim 5, further comprising means for quick-shifting said alarm hand means, which has been quick-shifted to a position indicating the alarm time by said quick-shifting means, to a first position of the alarm time.

7. A timepiece as claimed in claim 1, wherein said detecting means includes:

shift amount counting means for counting said predetermined time period signals; and, a coincidence detecting circuit for detecting a coincidence between a counting result of said shift amount counting means and one of said first and second time difference data stored in said alarm time data memory means.

8. A timepiece as claimed in claim 1, wherein said time difference memory means includes a RAM.

* * * * *